US009056230B2

(12) United States Patent
Golden et al.

(10) Patent No.: US 9,056,230 B2
(45) Date of Patent: Jun. 16, 2015

(54) COMPOSITE GOLF CLUB HEAD WITH IMPROVED SOUND

(75) Inventors: Charles E. Golden, Encinitas, CA (US); Uday V. Deshmukh, Carlsbad, CA (US)

(73) Assignee: Acushnet Company, Fairhaven, MA (US)

( * ) Notice: Subject to any disclaimer, the term of this patent is extended or adjusted under 35 U.S.C. 154(b) by 408 days.

(21) Appl. No.: 13/307,280

(22) Filed: Nov. 30, 2011

(65) Prior Publication Data

US 2013/0137531 A1 May 30, 2013

(51) Int. Cl.
*A63B 53/04* (2006.01)
*A63B 59/00* (2006.01)

(52) U.S. Cl.
CPC ..... *A63B 53/0466* (2013.01); *A63B 2053/0429* (2013.01); *A63B 59/0092* (2013.01); *A63B 2209/023* (2013.01); *A63B 2053/0433* (2013.01); *A63B 2053/0491* (2013.01); *A63B 2053/042* (2013.01); *A63B 2053/0462* (2013.01); *A63B 2209/02* (2013.01)

(58) Field of Classification Search
CPC ..... A63B 53/0466; A63B 2053/0429; A63B 59/0092; A63B 2209/023; A63B 2053/0433; A63B 2053/0491; A63B 2053/042; A63B 2053/0462; A63B 2209/02
USPC ..... 473/324–350, 287–292, 224, 234
See application file for complete search history.

(56) References Cited

U.S. PATENT DOCUMENTS 4,770,929 A * 9/1988 Nobumasa et al. ..... 442/278
4,856,801 A * 8/1989 Hollingsworth ..... 280/284
5,023,845 A * 6/1991 Crane et al. ..... 73/800
5,029,865 A 7/1991 Kim
5,314,180 A 5/1994 Yamagishi et al.
5,316,298 A 5/1994 Hutin et al.
5,332,178 A * 7/1994 Williams ..... 244/123.3
5,333,527 A * 8/1994 Janes et al. ..... 84/291
5,342,812 A 8/1994 Niskanen et al.
5,511,787 A 4/1996 Baum
5,692,972 A 12/1997 Langslet
5,855,526 A 1/1999 Honma
6,354,962 B1 3/2002 Galloway et al.
6,440,008 B2 8/2002 Murphy et al.
6,520,868 B2 2/2003 Chen
6,592,466 B2 * 7/2003 Helmstetter et al. ..... 473/224
6,642,308 B2 11/2003 Nomura et al.
6,648,774 B1 11/2003 Lee (Continued)

OTHER PUBLICATIONS

MIL-P-22581C(SH) Military Specification (Plastic Tiles, Vibration Damping, Type III)—Oct. 23, 19991.

*Primary Examiner* — Sebastiano Passaniti
(74) *Attorney, Agent, or Firm* — Kevin N. McCoy

(57) ABSTRACT

A composite golf club head with improved sound characteristics is disclosed herein. More specifically, the present invention relates to a golf club head that utilizes a unique composite type material having a low damping coefficient; creating more discretionary weight to optimize performance without comprising the sound of the golf club head. Depending on the amount of discretionary weight desired, the present invention could replace parts of the crown, the sole, the striking face, or even all three of the above referenced components with a low-damping composite material to improve the performance. The low-damping composite material used in accordance with the current invention may generally have a damping loss factor (η) of less than about 0.02.

20 Claims, 17 Drawing Sheets

(56) References Cited

U.S. PATENT DOCUMENTS

| | | | | |
|---|---|---|---|---|
| 6,723,012 | B1 * | 4/2004 | Sutherland | 473/567 |
| 6,773,360 | B2 | 8/2004 | Willett et al. | |
| 6,835,144 | B2 | 12/2004 | Best | |
| 6,866,593 | B1 * | 3/2005 | Cheng | 473/320 |
| 6,949,032 | B2 * | 9/2005 | Kosmatka | 473/342 |
| 7,128,662 | B2 * | 10/2006 | Kumamoto | 473/345 |
| 7,261,645 | B2 * | 8/2007 | Oyama | 473/345 |
| 7,267,620 | B2 * | 9/2007 | Chao et al. | 473/342 |
| 7,371,191 | B2 * | 5/2008 | Sugimoto | 473/345 |
| 7,402,113 | B2 * | 7/2008 | Mori et al. | 473/348 |
| 7,601,078 | B2 | 10/2009 | Mergy et al. | |
| 7,651,414 | B2 * | 1/2010 | Rae et al. | 473/346 |
| 7,686,707 | B2 | 3/2010 | Matsunaga et al. | |
| 7,722,479 | B2 | 5/2010 | Soracco | |
| 8,075,452 | B2 * | 12/2011 | Isaacson et al. | 482/30 |
| 8,221,261 | B2 * | 7/2012 | Curtis et al. | 473/329 |
| 2002/0037780 | A1 * | 3/2002 | York et al. | 473/560 |
| 2002/0076522 | A1 * | 6/2002 | Hsieh et al. | 428/113 |
| 2007/0117650 | A1 * | 5/2007 | Nakano | 473/345 |
| 2008/0146374 | A1 * | 6/2008 | Beach et al. | 473/350 |
| 2008/0167140 | A1 * | 7/2008 | De Shiell et al. | 473/342 |
| 2010/0170746 | A1 * | 7/2010 | Restuccia et al. | 181/290 |
| 2013/0109502 | A1 * | 5/2013 | Hayase et al. | 473/345 |

* cited by examiner

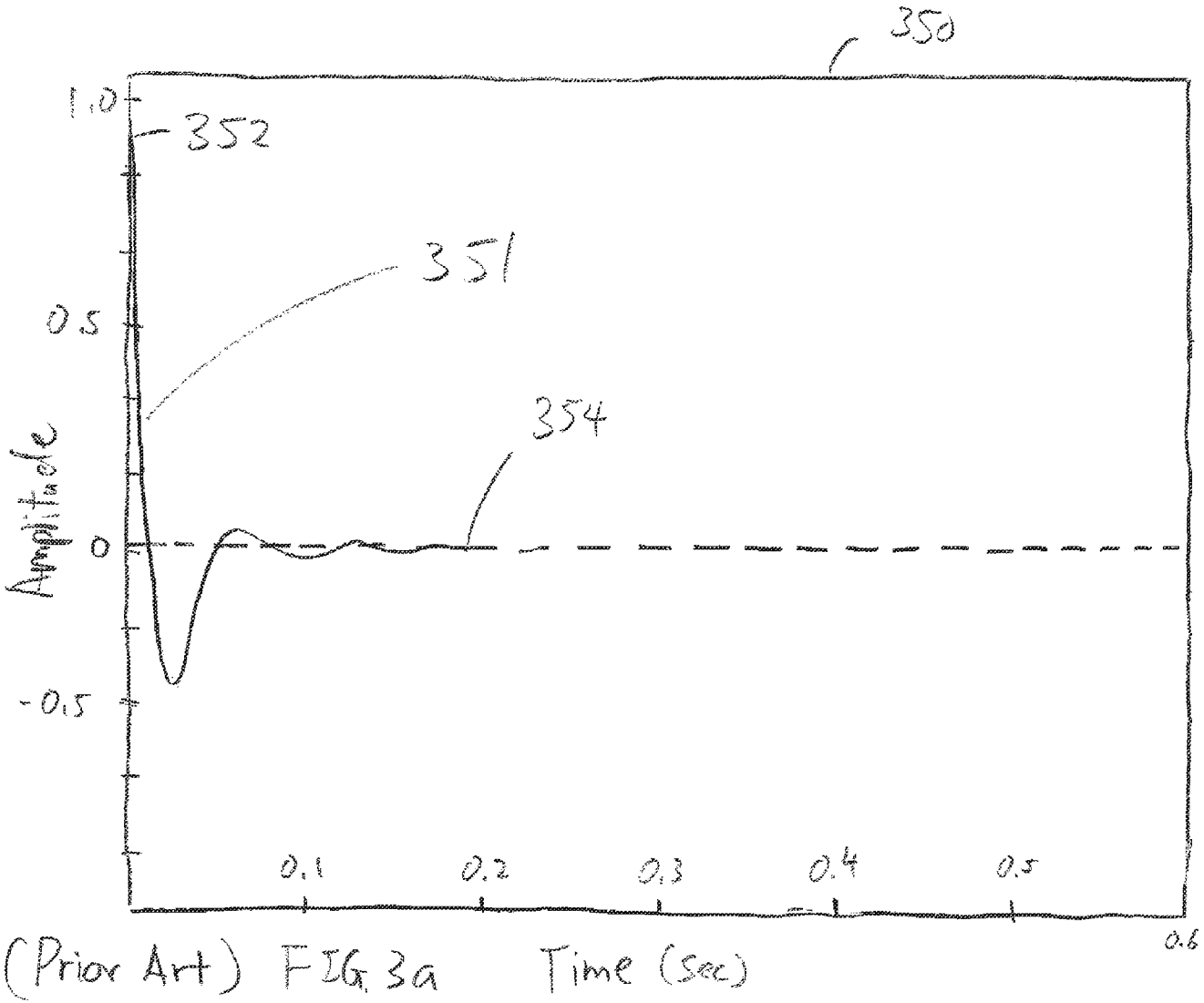
(Prior Art) FIG. 3a

COMPOSITE GOLF CLUB HEAD WITH IMPROVED SOUND

FIELD OF THE INVENTION

The present invention relates generally to a golf club that utilizes a unique composite type material that has a low loss damping coefficient; allowing weight to be reduced from various portions of the golf club head without compromising the sound of the golf club head. More specifically, the present invention relates to a golf club head wherein at least a portion of the club head is made out of a low-damping composite material, wherein the low-damping composite material has a damping loss factor ($\eta$) of less than about 0.02.

BACKGROUND OF THE INVENTION

One of the most notable improvements to golf equipments occurred in the early 1980's with the invention of the metalwood type golf club. The invention of the metalwood type golf club ushered in a new era of technologically advanced golf club designs that exponentially increased the performance of a driver type golf club, both in terms of distance and accuracy.

However, just like any other new ventures into unknown technological advancements, this new undertaking into unexplored design space provides numerous opportunities to investigate ways to further improve upon the basic concept in an area nobody has ever explored. U.S. Pat. No. 6,773,360 to Willett et al. shows one example of an attempt to further improve the performance of a metalwood type golf club head by incorporating weights into the body of the golf club head. Because a hollow metalwood type golf club head may generally have the ability to reduce a significant amount of weight by hollowing out the center of the golf club head, the excess weight saved can be shifted to locations that could improve the overall performance of the golf club head. More specifically, U.S. Pat. No. 6,773,360 provides a golf club head having adjustable weights, allowing the golfer to fine tune the club for his or her swing.

U.S. Pat. No. 6,354,962 to Galloway et al. shows another example of using technical advancements to take advantage of design space opened up by the advancement of the metalwood club by incorporating "variable face geometry" to the back of a striking face. Because the central core of the metalwood type golf club is hollowed out, it allows for different geometry to be incorporated into the internal wall profile of the club head by adjusting the thicknesses of the striking plate at various locations. More specifically, U.S. Pat. No. 6,354,962 shows a golf club having a striking plate having a thickness in the range of 0.010 to 0.250 inches, while the entire head may be composed of three pieces, a face, a sole, and a crown.

In addition to the above advancements in the utilization of metalwood type golf club, golf club designers have gone even further by experimenting with the usage of different materials to construct different portions of a metalwood type golf club head to achieve different performance properties. U.S. Pat. No. 5,855,526 to Honma illustrates this by teaching a golf club that combines different materials such as aluminum, stainless steel, titanium or the like for the body of the golf club; while components such as shaft sleeve are made of non-metallic material such as fiber reinforced plastic, wood or the like. Although not specifically requiring any of the golf club components to be made out of fiber reinforced plastic, U.S. Pat. No. 5,855,526's usage of the fiber reinforced plastic will become a common material used in golf club heads due to its lightweight and high strength characteristics.

U.S. Pat. No. 6,440,008 to Murphy et al. continues the trend of incorporating the aforementioned fiber reinforced plastic material into the striking face of the golf club head by disclosing a golf club having a head with a striking plate composed of a composite material and having a thickness in the range of 0.010 to 0.250 inches. U.S. Pat. No. 7,601,078 to Mergy et al. also shows the utilization non-metallic material, but this time into the rear body of the golf club head. U.S. Pat. No. 7,601,078 discloses a golf club head having a front body preferably made of metallic material and rear bodies are constructed out of a composite material in a way that the crown wall on the front body has a protruding section that mate with a recessed section of a crown wall on the rear body. The protruding section of the crown wall on the front body lies in a region of the club head that experiences the highest deflection and stress during impact with a golf ball.

Although the incorporation of fiber reinforced plastic in a golf club provides many performance benefits in reducing weight while maintaining a relative high level of structural integrity, the nature of fiber reinforced plastic tends to provide a significant amount of vibration dampening, which could also adversely affect the overall sound signature attenuation of the golf club itself via vibration. In fact U.S. Pat. No. 6,648,774 to Lee illustrates this undesirable dampening effect and tries to address this issue by combining metallic components with the composite type material. More specifically, U.S. Pat. No. 6,648,774 discloses a metal striking insert molded within the front face wall of the club head and is securely attached at the outside perimeter of the insert to the composite body and at the front corners of the composite body through the use of a sandwiched structure to offset the undesirable vibration attenuation of the composite material.

Despite all the performance gains achievable from the utilization of a composite type material, it can be seen that there is still a struggle to control the undesirable sound created by such composite type golf club heads. Attempts at controlling the sound often require the usage of a secondary material or stiffeners, which often negate the weight advantage achieved by the implementation of such composite type material. Hence, it can be seen from above, there is a need in the field for a golf club that can be constructed utilizing composite type material to take advantage of the performance benefits associated with such a material all without increased vibration damping of the golf club head to retain the acoustic sound of a golf club.

BRIEF SUMMARY OF THE INVENTION

In one aspect of the present invention is a golf club head comprising a striking face placed at a frontal portion of the golf club head and a body portion, having a crown and a sole, attached to an aft portion of the striking face. The golf club head has at least one of the striking face, the crown, or the sole formed out of a low-damping composite; wherein the low-damping composite has a damping loss factor of less than about 0.02.

In another aspect of the present invention is a golf club head comprising a striking face placed at a frontal portion of the golf club head and a body portion, having a crown and a sole, attached to an aft portion of the striking face. The golf club head has at least one of the striking face, the crown, or the sole formed out of low-damping composite; wherein the low-damping composite has a performance factor of greater than about 1,100 GPa*cc/g. The performance factor defined as the Young's Modulus of said low-damping composite divided by the damping loss factor and the density of said low-damping composite.

These and other features, aspects and advantages of the present invention will become better understood with references to the following drawings, description and claims.

BRIEF DESCRIPTION OF THE DRAWINGS

The foregoing and other features and advantages of the invention will be apparent from the following description of the invention as illustrated in the accompanying drawings. The accompanying drawings, which are incorporated herein and form a part of the specification, further serve to explain the principles of the invention and to enable a person skilled in the pertinent art to make and use the invention.

FIG. 3*a* shows a step response chart of the prior art high-damping composite in accordance with an exemplary embodiment of the present invention;

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features. However, any single inventive feature may not address any or all of the problems discussed above or may only address one of the problems discussed above. Further, one or more of the problems discussed above may not be fully addressed by any of the features described below.

Figure 1:
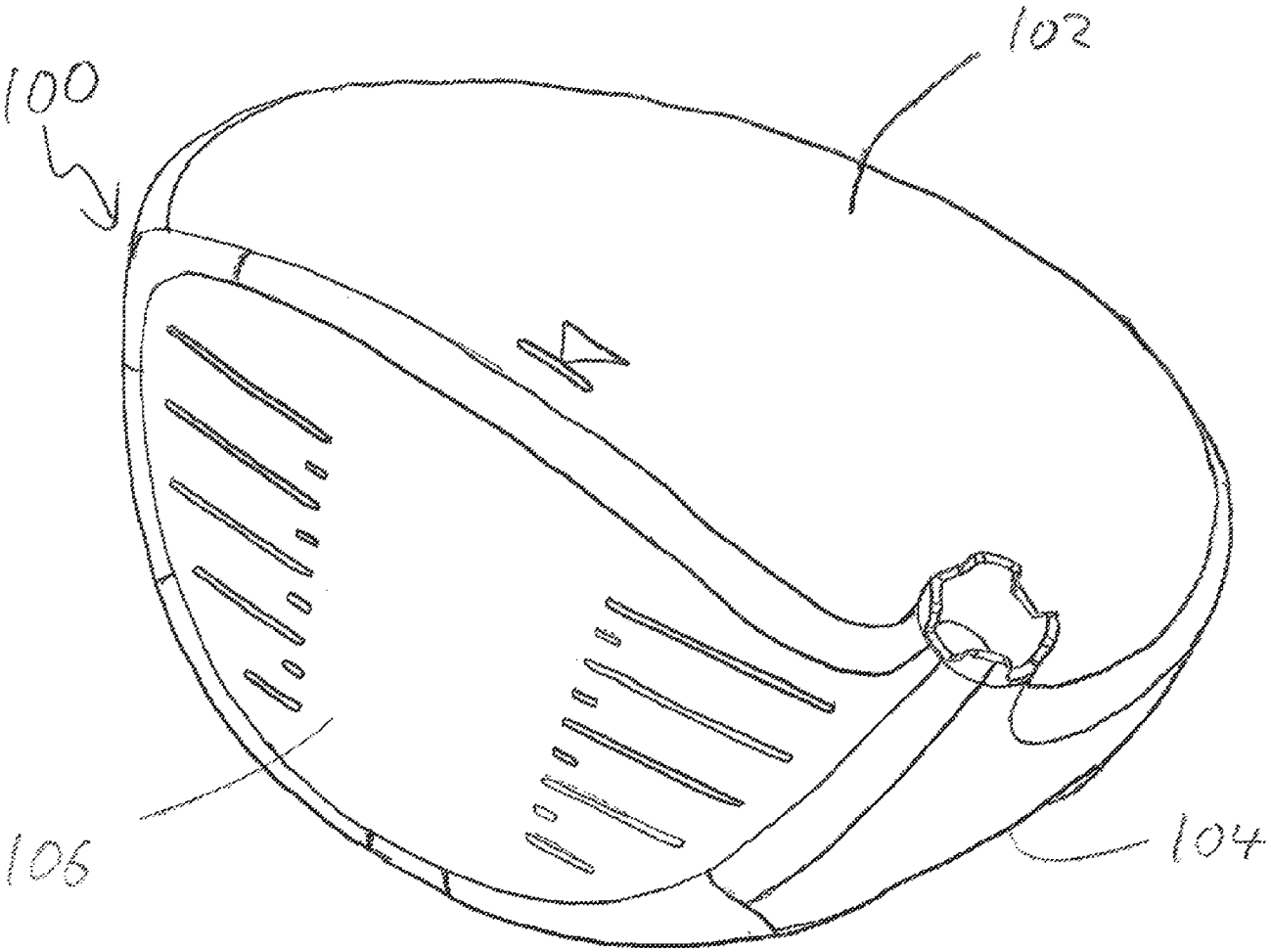
FIG. 1 shows a perspective view of a golf club head in accordance with an exemplary embodiment of the present invention.

FIG. 1 of the accompanying drawings shows a perspective view of a golf club head 100 in accordance with an exemplary embodiment of the present invention. More specifically, the golf club head 100 may generally have a crown 102, a sole 104, and a striking face 106. It should be noted that the present invention contemplates the incorporation of a low-damping composite type material into at least one of the crown 102, sole 104, or even the striking face 106 portions of the golf club head 100 to save weight. However, the present invention contemplates using a low-damping composite type material instead of the standard high-damping composite type material in order to preserve the acoustic sound characteristics of the golf club head. In one exemplary embodiment, at least a portion of the crown 102 may be formed out of a low-damping composite type material. In another embodiment, at least a portion of the sole 104 may be formed out of a low-damping composite type material. In another embodiment, at least a portion of the striking face 106 may be formed out of a low-damping composite type material.

Composite type materials, as it is generally known in the industry, may generally have a high damping loss factor ($\eta$), as it is often a desirable characteristic that benefits a lot of applications that utilize composite type materials. However, as mentioned above, such high damping loss coefficient ($\eta$) is undesirable in the golf club industry because the increased damping of a golf club head during impact reduces the ability of the golf club head to resonate, leaving the golf club head with a dead and undesirable sound. Hence, the low-damping composite type material in accordance with an exemplary embodiment of the present invention may generally have a relatively small damping loss factor ($\eta$) of less than about 0.02, more preferably less than about 0.01, and most preferably less than about 0.005.

In general, damping of an object can be classified into two categories, a material damping and a system damping. Material damping is defined as the intrinsic property of the material to dissipate energy in a volume of macro continuous media. System damping, on the other hand, relates to energy dissipation in the total structure. For ease of discussion, we begin our discussion on the material damping properties of the low-damping composite in accordance with the present invention, after which, the discussion will shift into the overall system damping and the acoustic sound power signals of the entire golf club head system. The focus of the subsequent discussion will be related to the material damping characteristics.

Material mechanical vibration damping can generally be defined as the ratio of energy dissipated (D) to a maximum strain energy (W) per cycle of vibration. Energy loss ratio units, as referred to in the context of this application may generally be represented by the symbol "η", and may be summarized by the following relationship established below in Eq. (1)

$$\eta = \frac{D}{2\pi W} = \frac{\delta}{\pi} = \frac{\psi}{2\pi} = \frac{1}{Q} = \frac{E''}{E} = \tan\omega = b = \frac{C}{C_c} \quad \text{Eq. (1)}$$

wherein;

η=damping loss factor or loss coefficient

D=unit damping energy; specific damping energy; energy dissipated per unit volume per cycle W=maximum strain energy stored during a cycle $\sigma^2/2E$ δ=logarithmic decrement ψ=specific damping capacity Q=quality factor or amplification factor E"=loss (or imaginary) modulus of elasticity–stress divided by that component of Strain, which is 90° out of phase with stress ($E''-D/\pi\epsilon^2$)

E=Storage (or elastic) modulus–stress divided by that component of strain which is in phase with the stress ω=angle (phase) by which sinusoidal stress vector lags sinusoidal strain vector in linear system b=blutness of resonance curve for linear system given by ratio of frequency band width of curve between half power points and resonant frequency $C/C_c$=damping ratio of linear system C=equivalent linear damping coefficient $C_C$=critical damping coefficient Although the basic theory and calculation of the vibration loss coefficient (η) is shown above, the actual vibration loss coefficient (η) of a composite type material may be measured using the steps articulated below.

A sample with a thickness of 10 mm is adhered to a steel plate of 5 mm thick with a two-liquid type epoxy adhesive and the result is left to stand for 24 hours. Thereafter U.S. Army Standard MIL-P-22581C (superseded MIL-P-22581B in 1991); the disclosure of which is incorporated by reference in its entirety; is used to determine the vibration decay waveform at room temperature of approximately 20° C., after which the vibration loss coefficient (η) is calculated to the following equations.

$$\eta=(C/C_C)/50 \quad \text{Eq. (2)}$$

wherein;

$$C/C_C(\%)=(183*D_E)*F \quad \text{Eq. (3)}$$

wherein;

$$D_E(\text{dB/sec})=D_0-D_B \quad \text{Eq. (4)}$$

wherein;

$$D_0(\text{dB/sec})=(F/N)*20*\log(A_1/A_2) \quad \text{Eq. (5)}$$

wherein;

F=frequency of the sample-adhered plate

N=number of periods taken into the calculation $A_1$=maximum amplitude in N $A_2$=minimum amplitude in N $D_0$=decay rate of sample-adhere plate $D_B$=decay rate of original steel plate $C/C_C$=percent critical damping $D_E$=effective Decay Rate η=damping loss factor More information regarding the steps taken to calculate the damping loss factor (η) of any sample can be found in U.S. Pat. No. 5,314,180 to Yamagishi et al., the disclosure of which is incorporated by reference in its entirety.

In addition to the damping loss factor (η) above, this inventive low-damping composite type material may generally have a relatively low density to ensure sufficient weight savings from the conventional titanium material used for a golf club head. More specifically, the inventive low-damping composite type material may generally have a density of less than about 4.50 g/cc, more preferably less than about 2.70 g/cc, and most preferably less than about 2.0 g/cc; all without departing from the scope and content of the present invention.

In addition to having a low density, the current inventive low-damping composite will generally have a Young's Modulus of greater than about 100 GPa in order to ensure sufficient bulk stiffness, more preferably greater than about 110 GPa, more preferably greater than about 120 GPa; all without departing from the scope and content of the present invention.

Based on the three (3) very important numbers above, it can be seen that the current inventive low-damping composite has very specific characteristics, that can be more easily characterized as a Performance Factor, defined as the Young's Modulus divided by the product of the damping loss factor (η) and the density, as shown in Equation (6) below:

$$\text{Performance Factor} = \frac{\text{Young's Modulus}}{\text{Damping Loss Coefficient } (\eta) * \text{Density}} \quad \text{Eq. (6)}$$

More specifically, the inventive low-damping composite in accordance with the present invention may generally have a Performance Factor of greater than about 1,100 GPa*cc/g, more preferably greater than about 4,000 GPa*cc/g, most preferably about 10,000 GPa*cc/g.

Figure 2A:
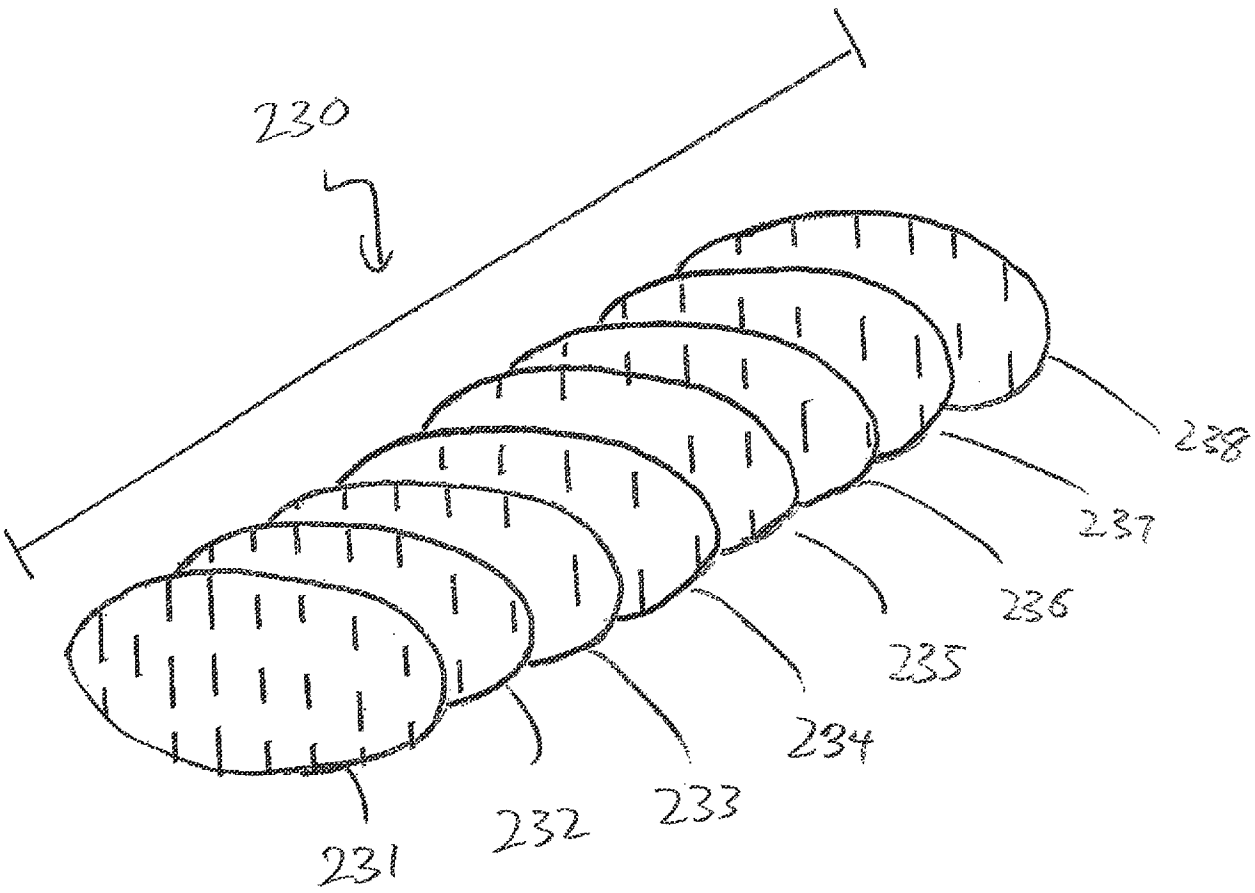
FIG. 2*a* shows an exploded view of a low-damping composite in accordance with an exemplary embodiment of the present invention, allowing the fiber orientations to be shown.
Figure 2B:
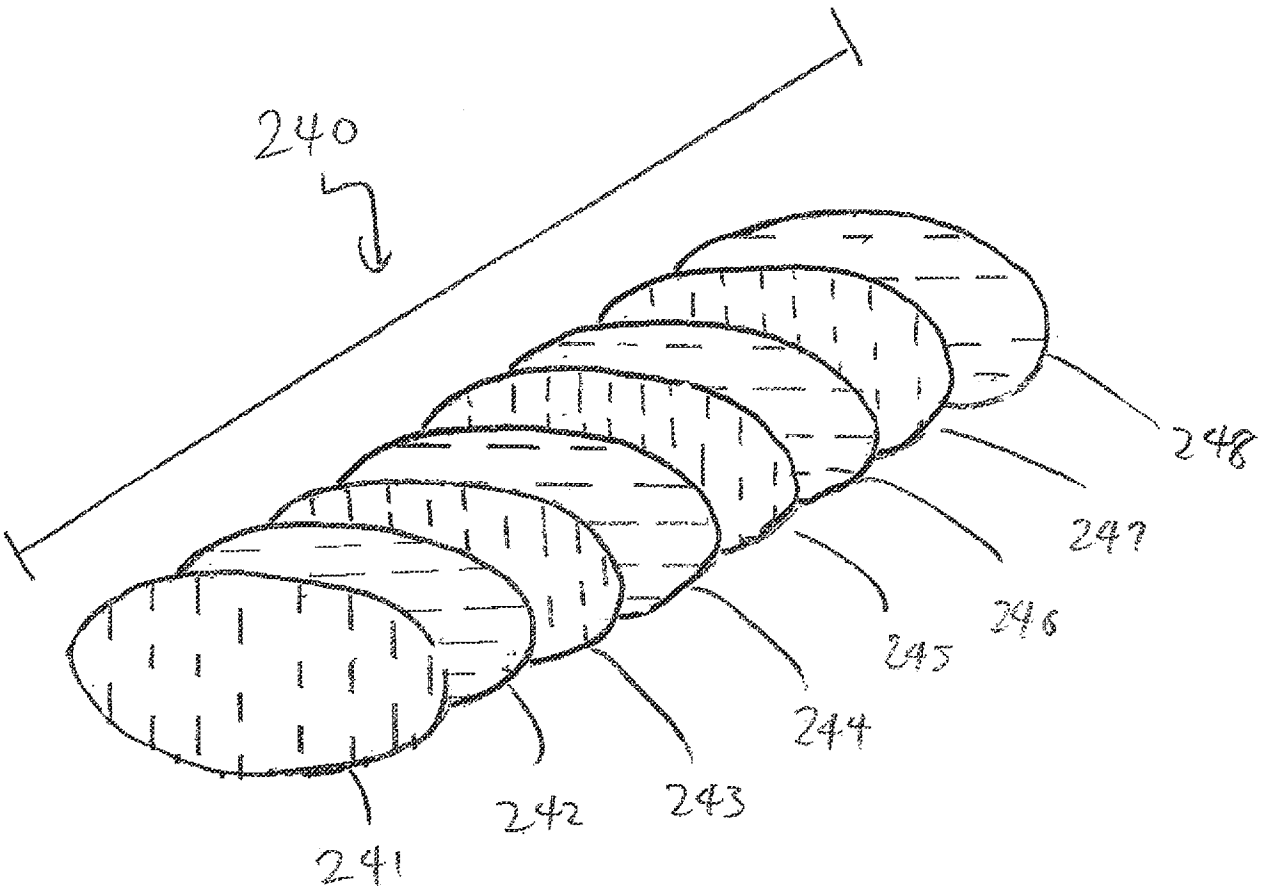
FIG. 2b (Prior Art)
FIG. 2*b* shows an exploded view of a prior art composite, allowing the prior art fiber orientation to be shown.

Although numerous methods can be used to create this new inventive low-damping composite material, the present invention discloses one preferred embodiment. Based on the research of the behavior of composite type material and their loss factor, the current inventors have discovered that there are two major contributors that could affect the overall damping loss factor (η) of a fiber impregnated composite type material; the fiber orientation of the composite, and the resin used to bond the composite layers. Based on the current research, it has been determined that a fiber orientation of 0 degrees from one another may generally yield a product with the lowest loss factor. With respect to the resin, the current research has shown that it is just a matter of finding the correct material. In the current exemplary embodiment, a resin such an epoxy resin or polyester resin may generally be used to achieve the current inventive low-damping composite material; however, any other types of resin may be used so long as it has a relatively low damping loss factor (η) all without departing from the scope and content of the present invention. In addition to the above major factors, there are several other factors that could also contribute to the overall damping loss factor (η) such as fiber to resin ratio, type of fiber, and different types of resin, which can all be adjusted to achieve the above numbers without departing from the scope and content of the present invention, FIG. 2*a* provides an exploded view of a fiber orientation used to form the current inventive low-damping composite material 230 in accordance with one exemplary embodiment of the current invention. More specifically, as it can be seen from FIG. 2*a*, the fiber orientation of this specific low-damping composite material has the fibers in all the layers 231, 232, 233, 234, 235, 236, 237, 238 in one orientation, which is in line with the results of the research above. This specific type of fiber orientation is significantly different from prior art fiber orientations that generally require the fiber orientations to alternate to take advantage of the fiber's inherent unidirectional strength. The difference in fiber lay-up is especially evident when compared to a prior art high-damping composite shown in FIG. 2*b*. More specifically, FIG. 2*b* of the accompanying drawings shows an exploded view of a fiber orientation used to create a prior art conventional high-damping composite material 240. This conventional high-damping composite material 240 may generally have the fiber layers alternating in 0 degree and 90 degree orientation as shown by layers 241, 242, 243, 244, 245, 446, 247, 248 of FIG. 2*b*.

Figure 2C:
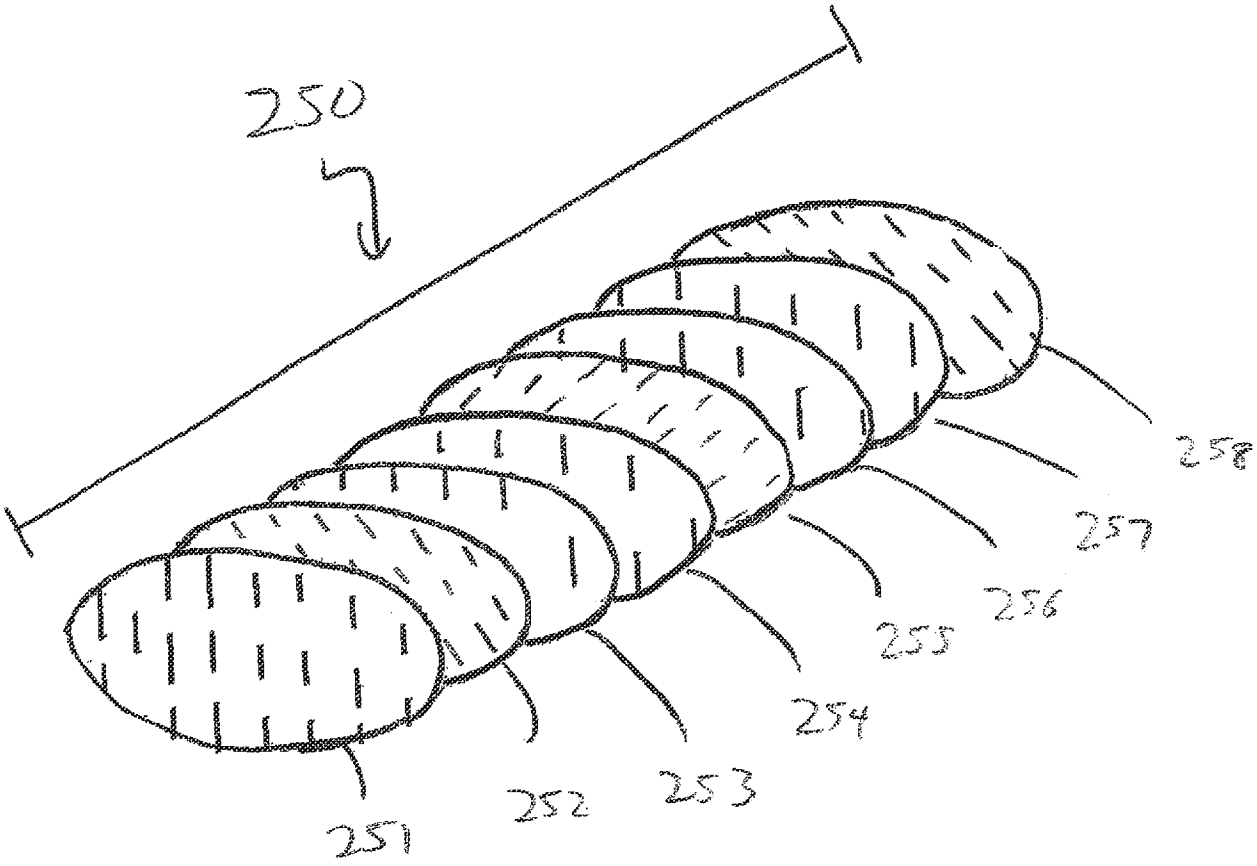
FIG. 2*c* shows an exploded view of a low-damping composite in accordance with an alternative embodiment of the present invention, allowing the fiber orientation to be shown.

However, despite the low-damping benefits, the unitary fiber orientations shown in FIG. 2*a* may come with some drawbacks in terms of sacrificing strength in the direction that bends parallel the unidirectional strength of the fibers. This drawback may or may not be of concern when used in a golf club head, depending on the location and placement of this low-damping composite material. Hence, in order to address this issue, the present invention provides an alternative embodiment shown in FIG. 2*c*, wherein a majority of the fibers are orientated in the same 0 degree orientation, with a small number of fibers orientated in an orientation that is less than 45 degree offset from the 0 orientation in either direction, more preferably less than 30 degree offset from the 0 orientation, and most preferably less than 15 degrees offset from the 0 orientation. Because the current research shows the amount of damping loss factor ($\eta$) decreases as a function of the angle of deviation from the 0 degree orientation, it is preferable to keep such deviation as small as possible. In FIG. 2*c*, an exploded view of fiber orientation is shown in accordance with an alternative embodiment of the present invention wherein a majority of the fiber layers are maintained at the 0 degree direction, with minor layers in a direction that is offset from the 0 degree direction. More specifically, in FIG. 2*c*, layers 251, 254, 254, 256, and 257 are all orientated in the 0 degree orientation, while layers 252, 255, and 258 are orientated slightly offset from the 0 degree orientation to provide some strength in an alternative direction. Hence, it can be said that in this alternative embodiment of the present invention, greater than 50% of the layers are orientated in the same orientation.

Figure 3B:
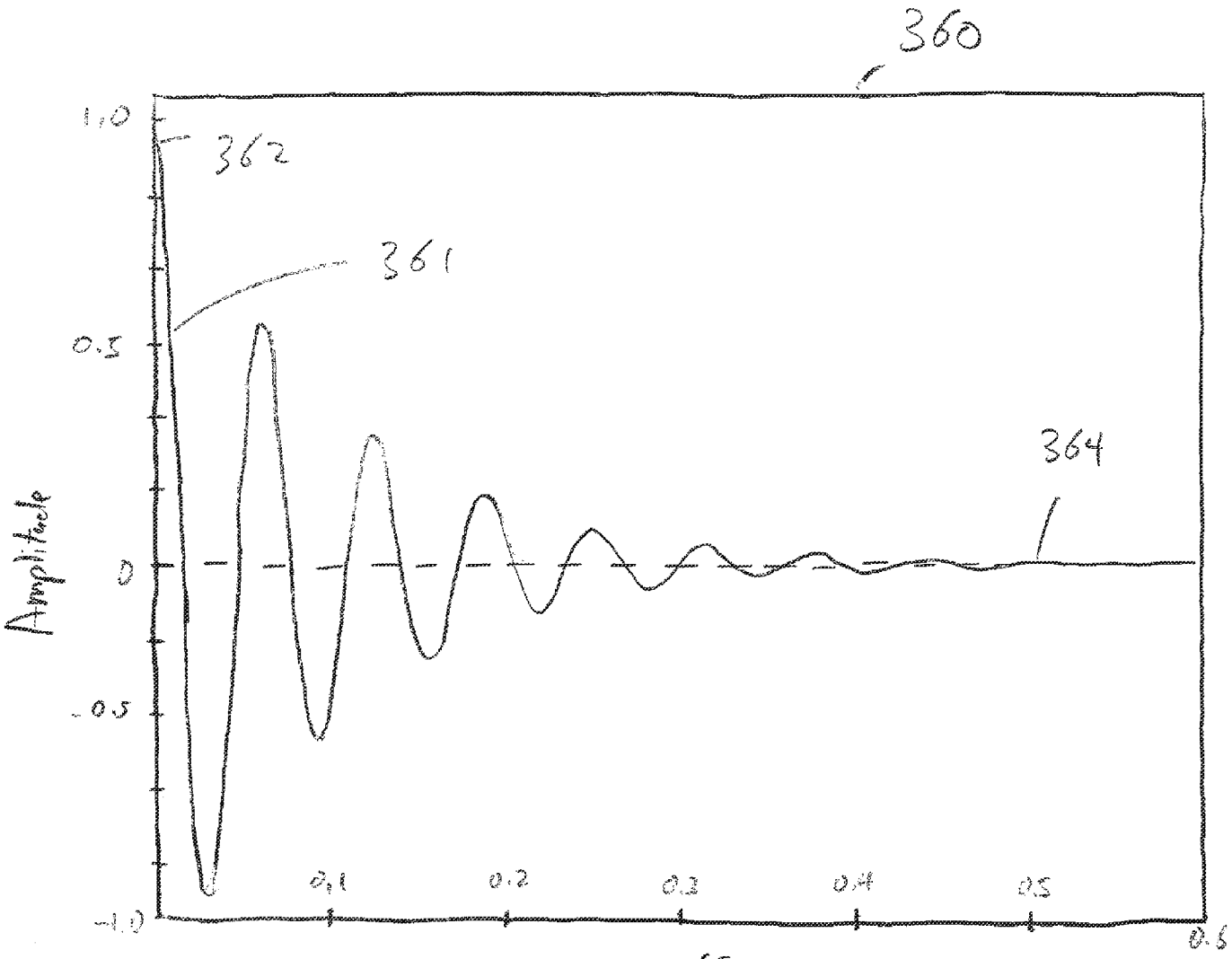
FIG. 3*b* shows a step response chart of a current art low-damping composite in accordance with an exemplary embodiment of the present invention.

FIGS. 3*a* and 3*b* of the accompanying drawings shows a step response chart of the current composite type material having a low damping coefficient compared with a conventional prior art composite type material. More specifically, FIG. 3*a* of the accompanying drawings shows a step response chart 350 of a prior art composite type material and FIG. 3*b* of the accompanying drawings shows a step response chart 360 of a composite type material in accordance with the current embodiment of the present invention. As it can be seen from FIG. 3*a* of the accompanying drawings, the step response 351 of a prior art composite type material at the starting point 352 begins at a high amplitude of close to 1, but quickly dampens out at the terminal point 354 after about 0.2 seconds after impact with a golf ball. Alternatively, compared to FIG. 3*b* of the accompanying drawings, the step response 361 of the current inventive low-damping composite type material also starts at a starting point 362 that has amplitude of close to 1; however the similarities stop there. FIG. 3*b* shows the step response 361 of the current inventive low-damping composite material taking significantly longer to absorb and dampen the vibrations generally associated with an impact of a golf club with a golf ball. More specifically, as it is clearly shown in FIG. 3*b*, the amount of time that it takes to completely dampen the same amount of amplitude of vibration takes greater than about 0.5 seconds, which is more than twice as long as it would have taken a traditional prior art high damping composite type material.

Figure 4:
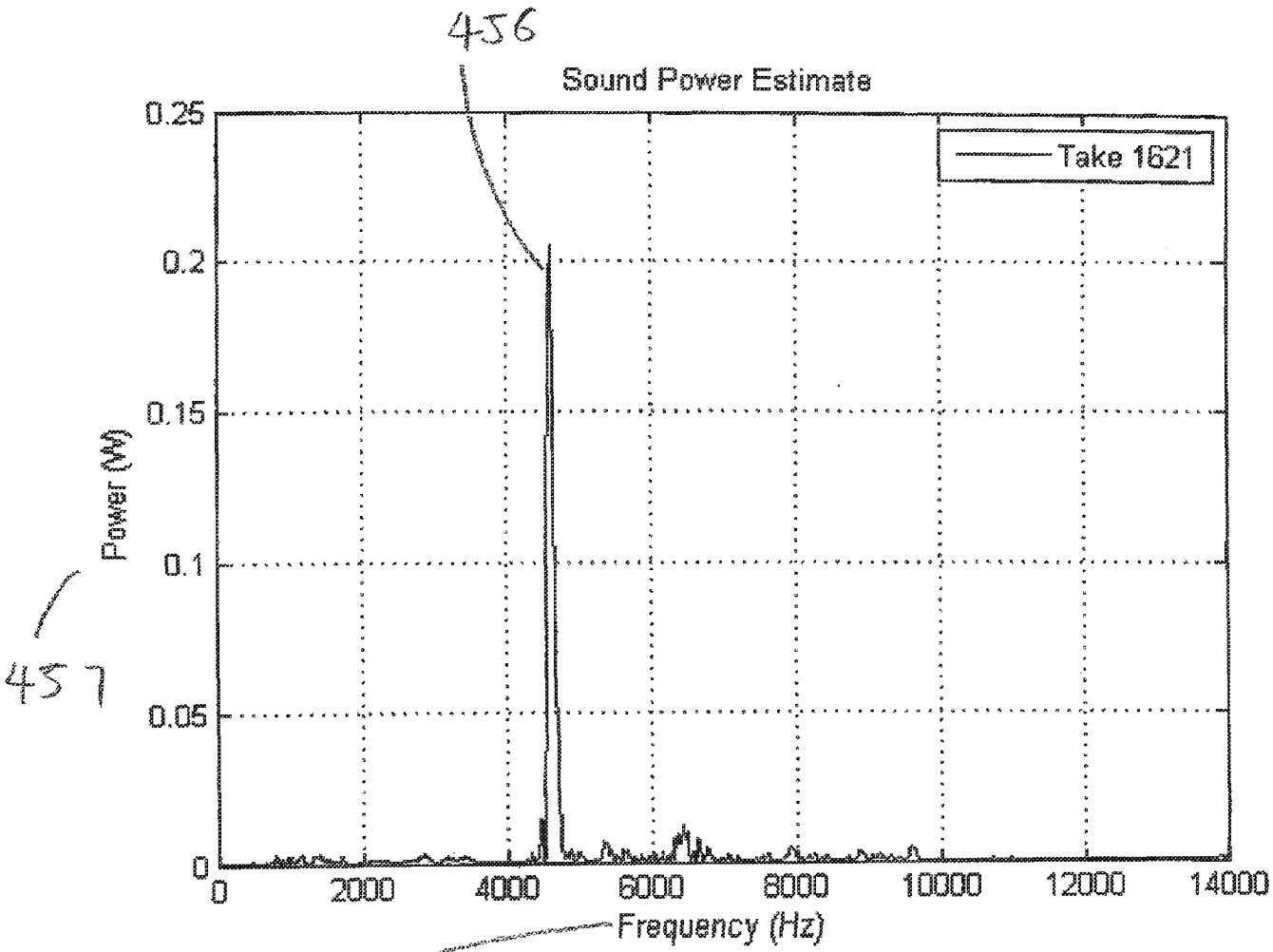
FIG. 4 (Prior Art)
FIG. 4 shows a signal power diagram of a prior art metallic golf club head, representative of the sound as the metallic golf club head impacts a golf ball.
Figure 5:
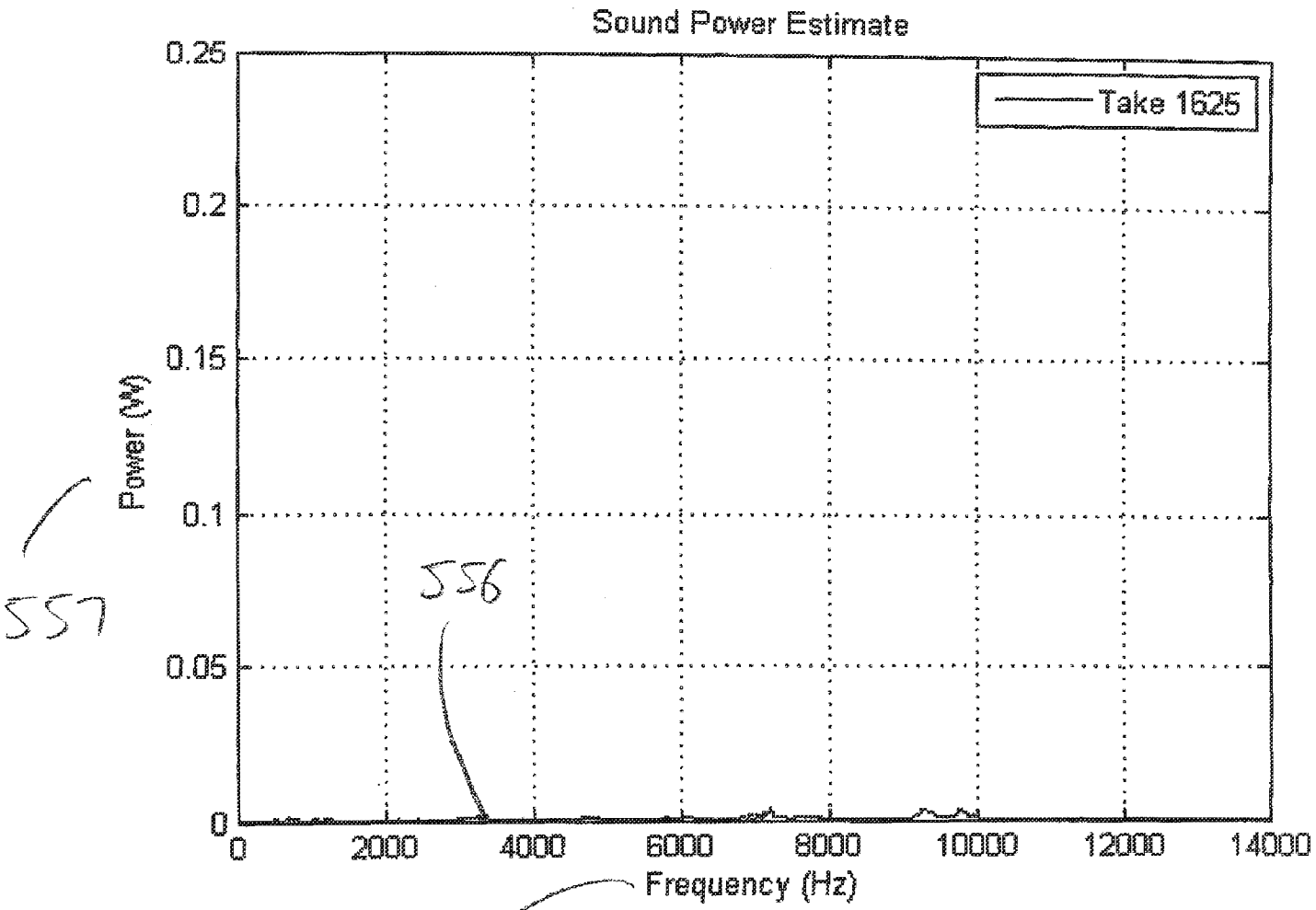
FIG 5 (Prior Art)
FIG. 5 shows a signal power diagram of a prior art golf club head made using a high-damping composite material, representative of the sound as the golf club head using a high-damping composite material impacts a golf ball.
Figure 6:
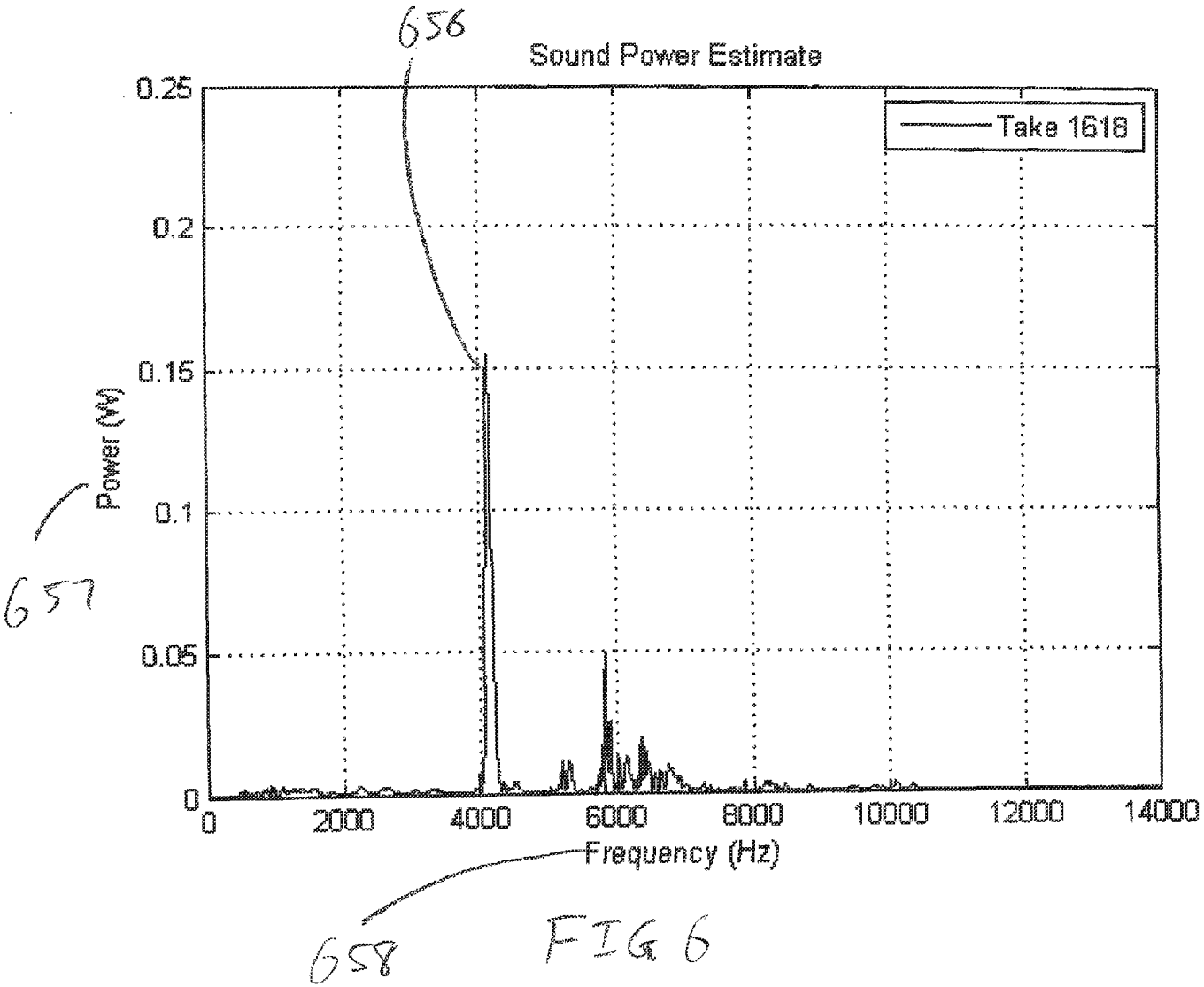
FIG. 6 shows a signal power diagram of the current inventive golf club head made using a low-damping composite material, representative of the sound as the golf club head using a low-damping composite material impacts a golf ball.

In order to further understand how this inventive low-damping composite type material affects the sound of a golf club head, FIGS. 4-6 of the accompanying drawings shows signal power diagrams of a golf club utilizing traditional high-damping composite compared with a conventional titanium golf club head as well as the current inventive golf club head having the low-damping composite.

FIG. 4 of the accompanying drawings shows a signal power diagram of a prior art golf club head that is completely made out of a titanium type material, illustrating the acoustic characteristics of a golf club head that produces a desirable sound. More specifically, FIG. 4 captures the power 457 of the sound generated by this particular prior art golf club head as it impacts a golf ball as a function of the sound frequency 458. This power 457 and frequency 458 may quantify the vibration of the various components of the golf club head such as the crown, the sole, the face, or any other component of the golf club head as it impacts a golf ball. As we can see from FIG. 4, this prior art golf club head that is completely made out of titanium may produce a first peak 456 in sound power 457 just above 4,000 hertz. The peak 456 sound power 457, as shown in this current prior art golf club head may have amplitude of about 0.2 watts. Hence, based on the above, it can be observed that a desirous sound of a golf club head with a completely metallic striking face may have a first peak of power at a frequency that is greater than about 3,500 hertz, more preferably greater than about 3,750 hertz, and most preferably greater than about 4,000 hertz.

FIG. 5 of the accompanying drawings shows a signal power diagram of a prior art golf club head that incorporates a conventional prior art high-damping composite, illustrating the dramatic change in the acoustic sound characteristic of such a type of golf club head. Right off the bat, one can see from FIG. 5 the power 557 of the sound produced by this prior art golf club is much duller, due to the sound attenuating vibrations being absorbed by the conventional composite type material. Although barely noticeable when plotted on a same scale as the diagram in FIG. 4, this prior art golf club head may generally have a total sound power 557 output of less than about 0.002 watts. Hence, when compared to the signal power diagram of a completely metallic golf club head shown in FIG. 4, one can see that incorporating a high damping composite into a golf club head deprives it of the ability to achieve a desirable sound.

Turning now to FIG. 6 of the accompanying drawings, we can see the signal power diagram of a golf club head in accordance with the current invention that uses a low-damping composite type material. Even upon initial glance, it is immediately noticeable that the signal power diagram of the current invention resembles the signal power diagram of a metallic golf club head as shown in FIG. 4 instead of the signal power diagram of a prior art high damping composite golf club head shown in FIG. 5. More specifically, the signal power diagram of the current invention may have a first peak 656 in sound power 657 occurring at greater than about 3,500 hertz and less than about 4,500 hertz, more preferably greater than 3,750 hertz and less than about 4,250 hertz, and most preferably about 4,000 hertz. The peak 656 sound power 657 of the current invention may generally have an output of greater than about 0.1 watts, more preferably greater than about 0.125 watts, and most preferably about 0.15 watts.

Because the desirability of the acoustic sound coming from a golf club is dependent upon the values mentioned above, it should be much easier to quantify these values as a relationship to one another for ease of comparison. Equation (7) below creates a peak power to frequency ratio that captures the desirability of the sound that a golf club head makes as it impacts a golf ball:

$$\text{Peak Power to Frequency Ratio} = \frac{\text{Peak Power}}{\text{Frequency where Peak Power Occurs}} \quad \text{Eq. (7)}$$

The peak power to frequency ratio of a golf club head in accordance with an exemplary embodiment of the present invention may generally be greater than about $2.5*10^{-5}$ watts/hertz and less than about $5*10^{-5}$ watts/hertz, more preferably greater than about $3.0*10^{-5}$ watts/hertz and less than about $4.5*10^{-5}$ watts/hertz, and most preferably about $4.0*10^{-5}$ watts/hertz.

The signal power diagrams shown above are captured using audio recorders such as the TASCAM® DH-P2 Portable High-Definition Stereo Audio Recorder with an A-weighting microphone recording the sound of a golf club head impact with a golf ball. The microphone is generally placed at 39 inches away from the impact location to obtain the audio recording of a golf club impacting a golf ball used to create the signal power diagrams shown in FIGS. 4-6. It should be noted that although the above equipment is used in a preferred embodiment for capturing the sound of a golf club head as it impacts a golf ball, other types of audio recorders may be used without departing from the scope and content of the present invention so long as it is capable of capturing the sound of impact between a golf club and a golf ball.

Figure 7:
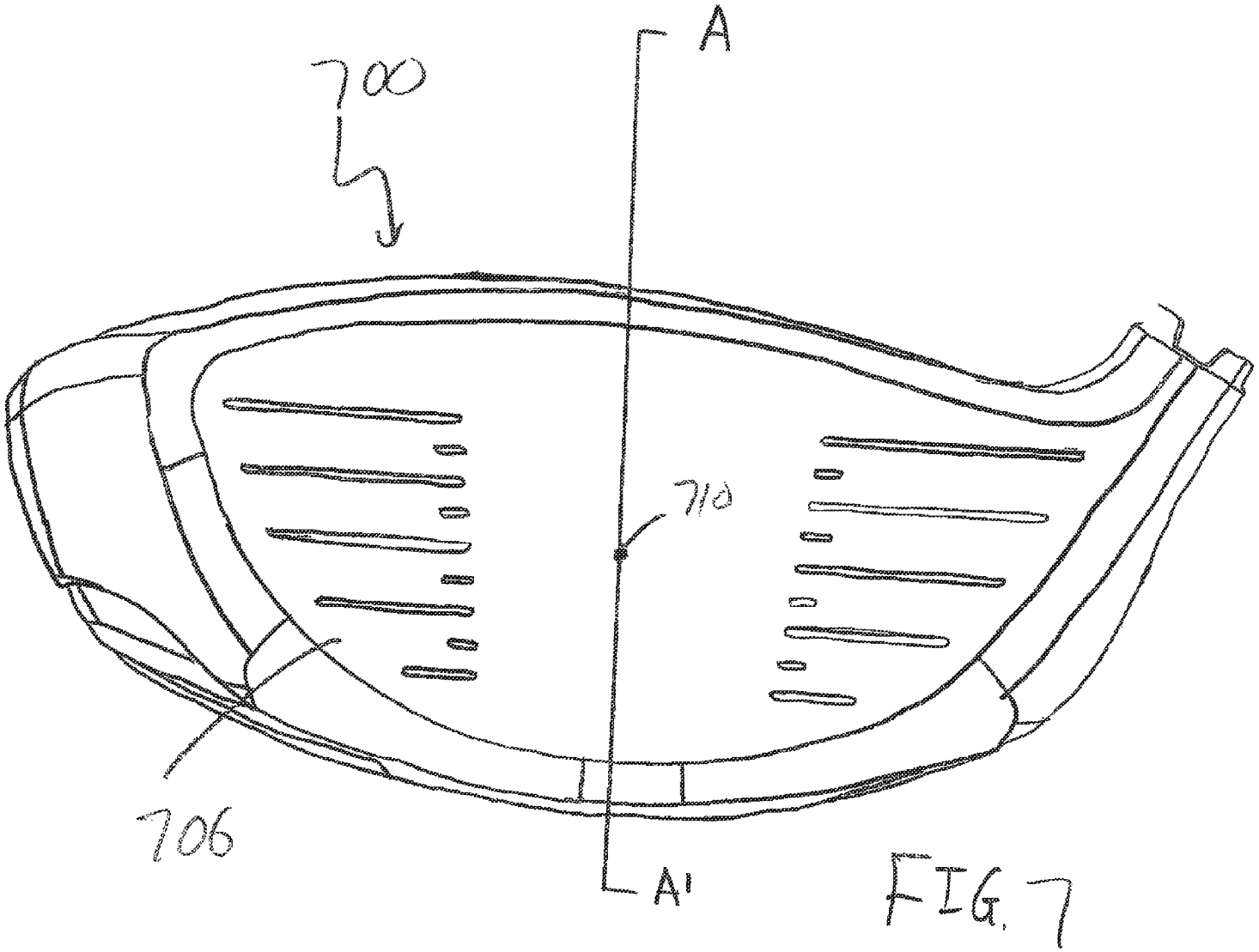
FIG. 7 shows a shows a frontal view of a golf club head in accordance with an exemplary embodiment of the present invention, allowing cross-sectional line A-A' to be shown.

FIG. 7 of the accompanying drawings shows a frontal view of a golf club head 700 in accordance with an exemplary embodiment of the present invention. This frontal view of the golf club head 700 illustrating the striking face 706 allows a cross-sectional line A-A' to be drawn through the geometric center 710 of the striking face 706. This cross-sectional line A-A' allows the internal geometry of different embodiments of the golf club head to be shown more clearly in the subsequent figures, as the incorporation of the current inventive low-damping composite can be hard to detect visually.

Figure 8:
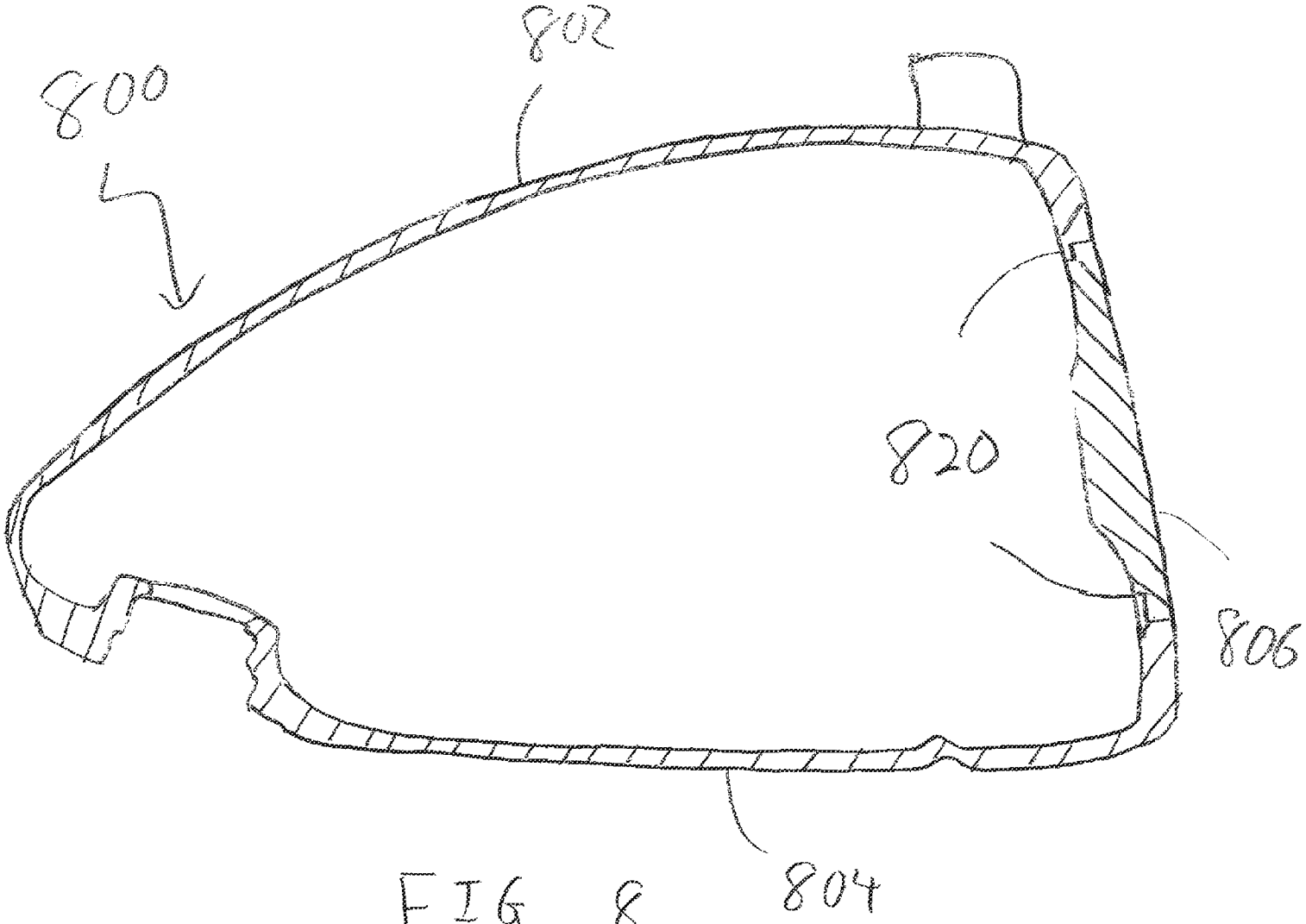
FIG. 8 shows a cross-sectional view of a golf club head in accordance with an exemplary embodiment of the present invention taken along cross-sectional line A-A' as shown in FIG. 7.

FIG. 8 of the accompanying drawings shows a cross-sectional view of a golf club head 800 in accordance with an exemplary embodiment of the present invention taken along cross-sectional line A-A' shown in FIG. 7. More specifically, in this current exemplary embodiment, the crown 802, the sole 804, and the perimeter portion of the striking face 806 have all been replaced with the high damping composite type material discussed below; leaving only a face insert at the center of the striking face 806 that is made out of a conventional titanium material for it's strength to withstand repeated impact with a golf ball. It should be noted that in this current exemplary embodiment of the present invention, the boundaries of the two different materials may generally be comprised of a notch 820, to create an easier mating surface between the various components.

Figure 9:
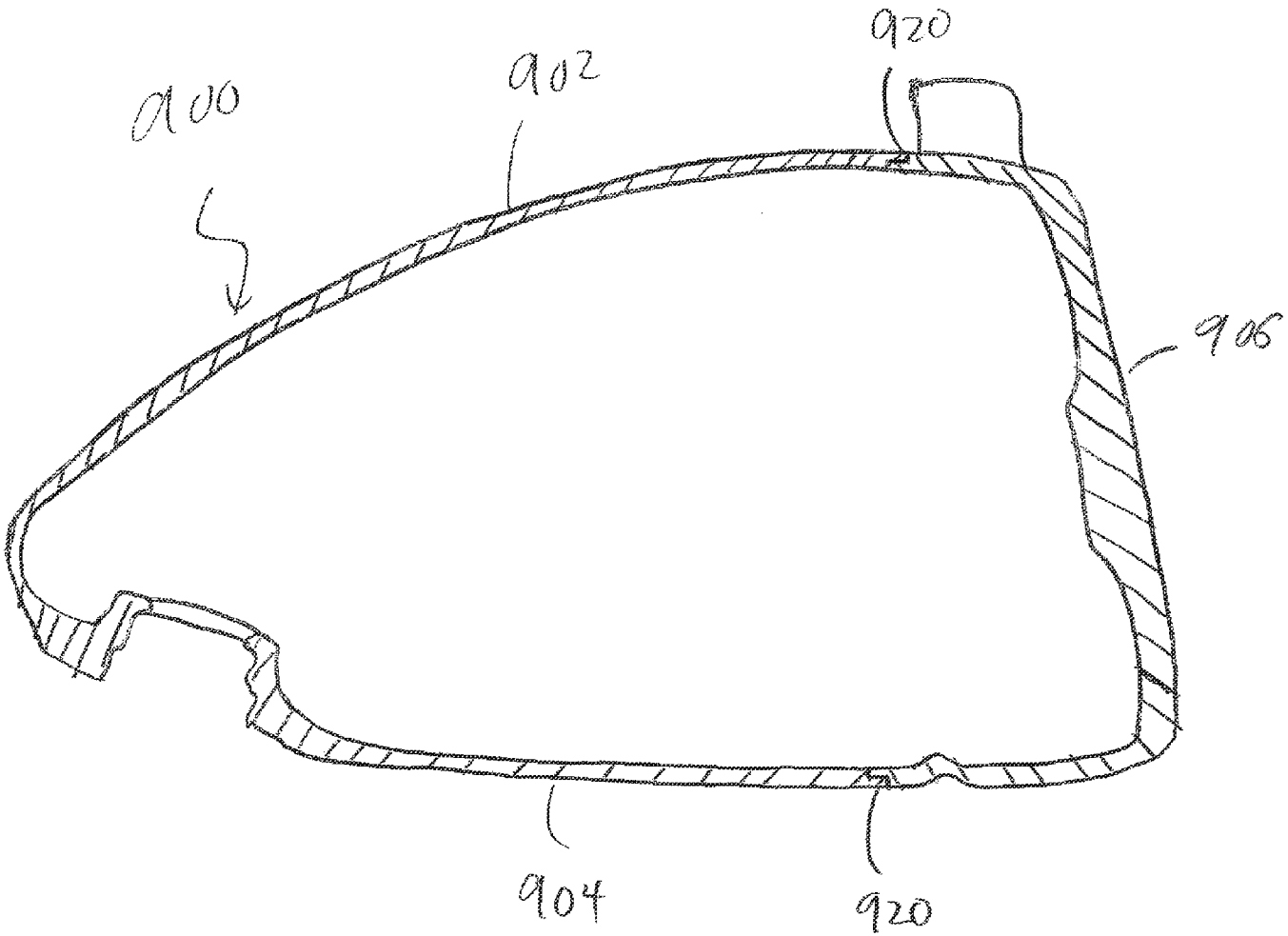
FIG. 9 shows a cross-sectional view of a golf club head in accordance with an exemplary embodiment of the present invention taken along cross-sectional line A-A' as shown in FIG. 7.

FIG. 9 of the accompanying drawings shows a cross-sectional view of a golf club head 900 in accordance with an alternative embodiment of the present invention taken along cross-sectional line A-A' shown in FIG. 7. Here, similar to golf club head 800 shown in FIG. 8, the crown, 902 and the sole 904 are all made out of the high damping composite type material. However, in this current exemplary embodiment, the entire striking face 906 is made from the conventional titanium material into a shape of a face cup. In this current exemplary embodiment, the notches 920 are placed at the front end of the crown 902 and the front end of the sole 904 to allow the mating locations to be shifted further away from the high stresses points that could result from high speed impact with a golf ball.

Figure 10:
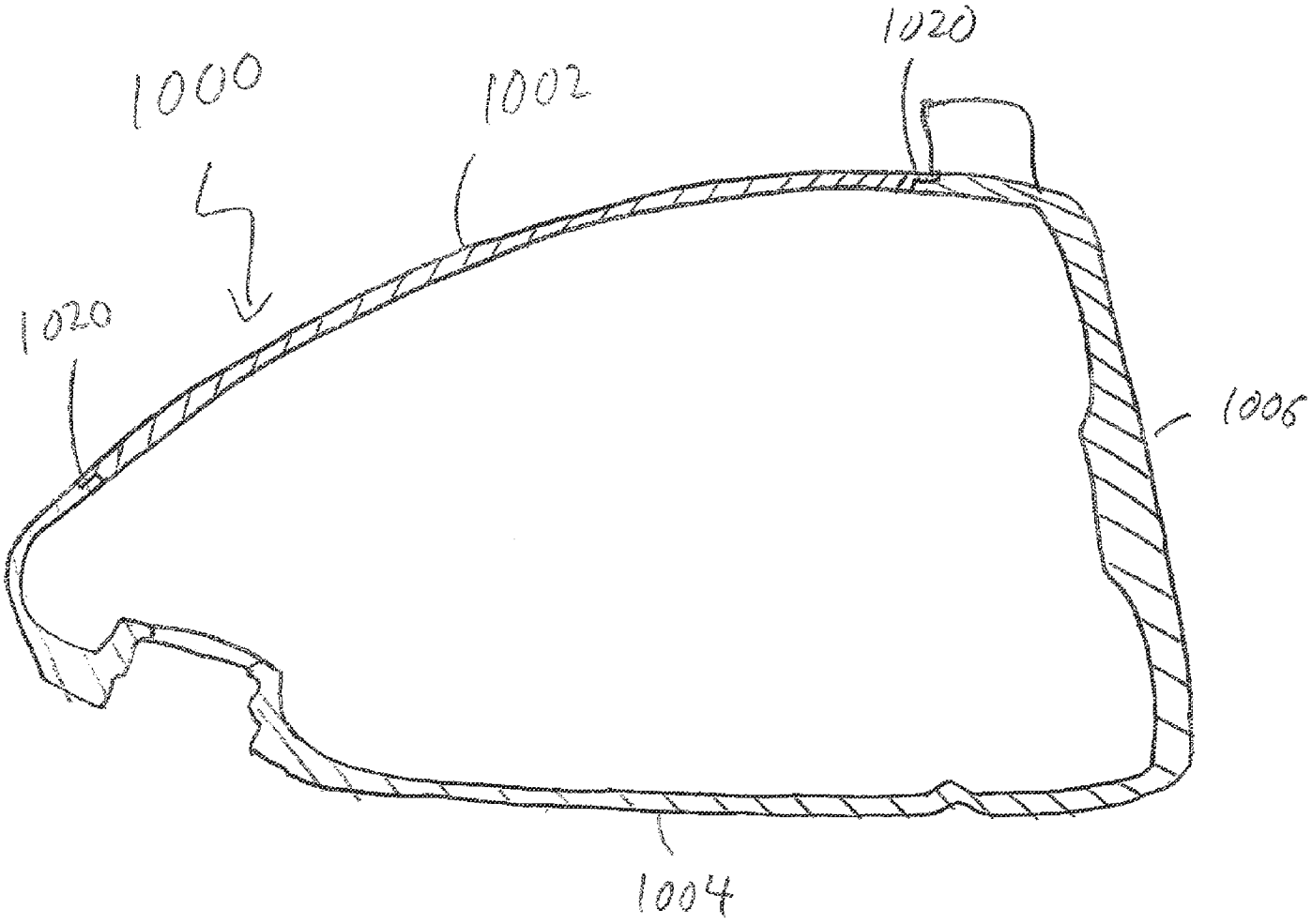
FIG. 10 shows a cross-sectional view of a golf club head in accordance with an exemplary embodiment of the present invention taken along cross-sectional line A-A' as shown in FIG. 7.

FIG. 10 of the accompanying drawings shows a cross-sectional view of a golf club head 1000 in accordance with an alternative embodiment of the present invention taken along cross-sectional line A-A' shown in FIG. 7. In this current exemplary embodiment of the present invention only parts of the crown 1002 is replaced with the current inventive low-damping composite material, allowing the golf club head 1000 to shave weight from a strategic location. This current exemplary embodiment maintains the sole 1004 and the striking face 1006 to be the traditional titanium material for its high strength and light weight characteristics. In this exemplary embodiment notches 1020 separates the crown 1002 and the remainder of the golf club head 1000. This current exemplary embodiment shown in FIG. 10 may be preferred in certain designs wherein it would be desirable to remove weight from the upper portion of the golf club head and moved to a lower portion, creating a low and deep center of gravity.

Figure 11:
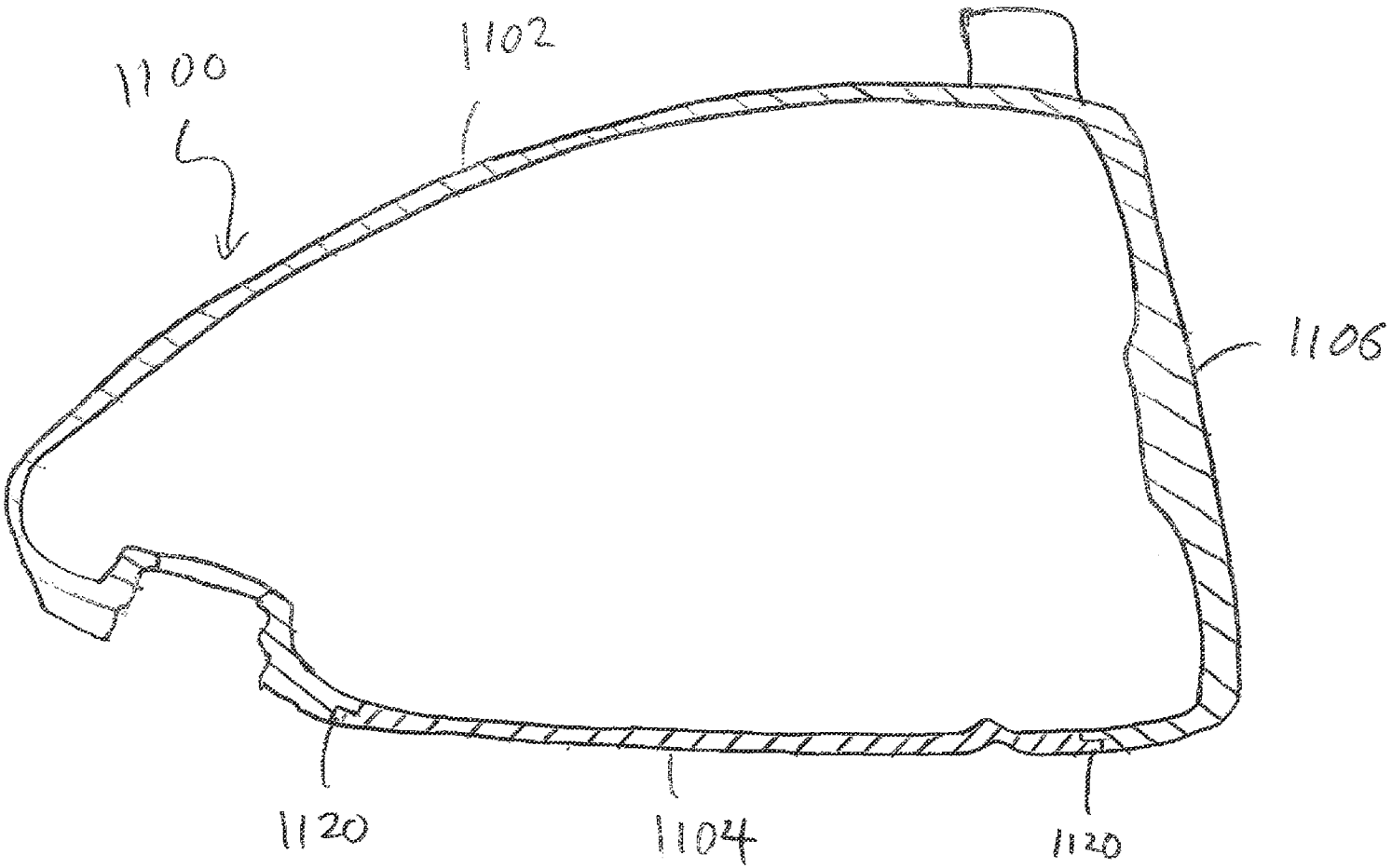
FIG. 11 shows a cross-sectional view of a golf club head in accordance with an exemplary embodiment of the present invention taken along cross-sectional line A-A' as shown in FIG. 7.

FIG. 11 of the accompanying drawings shows a cross-sectional view of a golf club head 1100 in accordance with an alternative embodiment of the present invention taken along cross-sectional line A-A' shown in FIG. 7. In this current exemplary embodiment of the present invention, only parts of the sole 1104 is replaced with the current inventive low-damping composite material, allowing the golf club head 1100 to shave weight from a strategic location. In this exemplary embodiment, notches 1020 separate the sole 1104 from the remainder of the golf club head 1100. By replacing the sole 1104 with a composite material, more weight can be saved from the body portion of the golf club head 1100, allowing the saved weight to be placed at alternative locations to improve the performance of the golf club head 1104.

Figure 12:
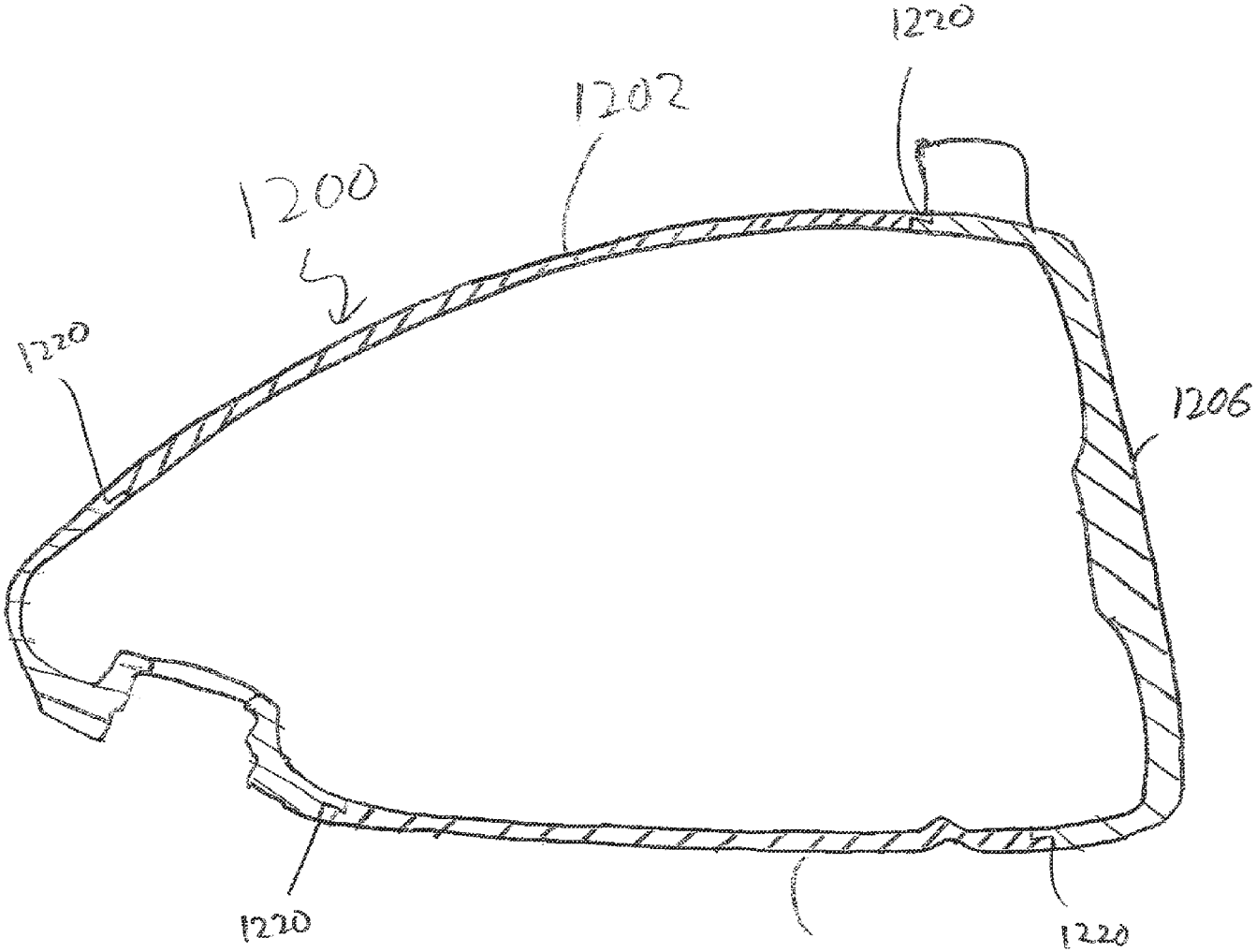
FIG. 12 shows a cross-sectional view of a golf club head in accordance with an exemplary embodiment of the present invention taken along cross-sectional line A-A' as shown in FIG. 7.

FIG. 12 of the accompanying drawings shows a cross-sectional view of a golf club head 1200 in accordance with an alternative embodiment of the present invention taken along cross-sectional line A-A' shown in FIG. 7. In this current exemplary embodiment of the present invention both the crown 1202 and the sole 1204 are replaced with the current inventive low-damping composite material, allowing the golf club head 1200 to save significant weight. This specific embodiment may generally require several notches 1220 and joints to ensure the components stay attached, but maintaining some of the structural integrity by using titanium materials at or around the skirt of the golf club head 1200.

Figure 13:
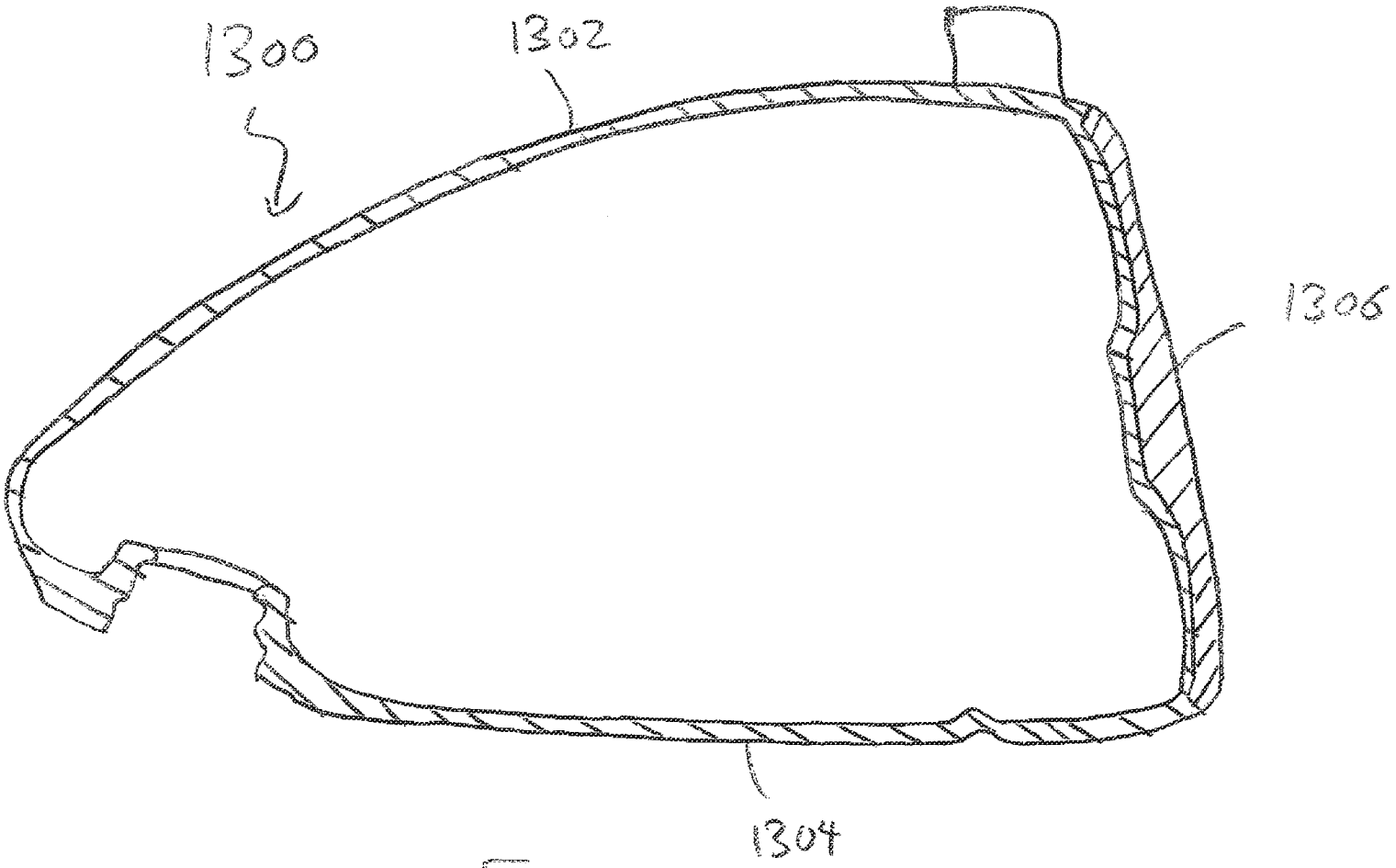
FIG. 13 shows a cross-sectional view of a golf club head in accordance with an exemplary embodiment of the present invention taken along cross-sectional line A-A' as shown in FIG. 7.

FIG. 13 of the accompanying drawings shows a cross-sectional view of a golf club head 1300 in accordance with an alternative embodiment of the present invention taken along cross-sectional line A-A' shown in FIG. 7. In this current exemplary embodiment of the present invention a pocket is created in the striking face 1306 portion of the golf club head to allow an external portion of the striking face 1306 to be replaced with the current inventive low-damping composite material. This specific embodiment of the present invention may be preferred in situations wherein it may be desirable to save weight from the striking face 1306 portion of the golf club head 1300.

Figure 14:
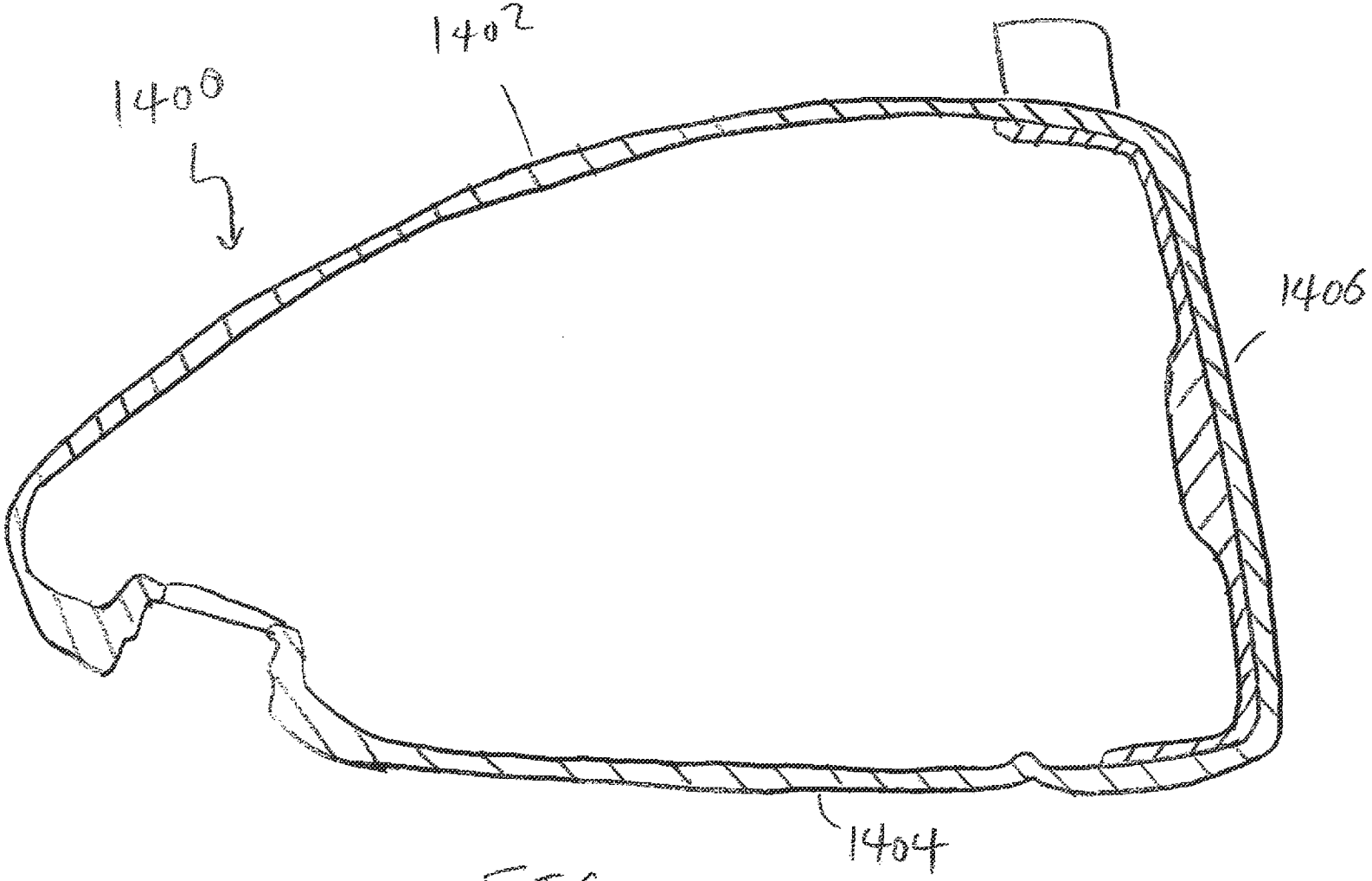
FIG. 14 shows a cross-sectional view of a golf club head in accordance with a further alternative exemplary embodiment of the present invention taken along cross-sectional line A-A' as shown in FIG. 7.

FIG. 14 of the accompanying drawings shows a cross-sectional view of a golf club head 1400 in accordance with an alternative embodiment of the present invention taken along cross-sectional line A-A' shown in FIG. 7. In this current exemplary embodiment of the present invention, the low-damping composite material is attached to an internal portion of the striking face 1406 without the need to create a pocket. This specific embodiment of the present invention may be preferred in situations wherein in the weight savings of the striking face 1406 is achieved by a concealing the composite from view.

Other than in the operating example, or unless otherwise expressly specified, all of the numerical ranges, amounts, values and percentages such as those for amounts of materials, moment of inertias, center of gravity locations, loft, draft angles, various performance ratios, and others in the aforementioned portions of the specification may be read as if prefaced by the word "about" even though the term "about" may not expressly appear in the value, amount, or range. Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting form the standard deviation found in their respective testing measurements. Furthermore, when numerical ranges of varying scope are set forth herein, it is contemplated that any combination of these values inclusive of the recited values may be used.

It should be understood, of course, that the foregoing relates to exemplary embodiments of the present invention and that modifications may be made without departing from the spirit and scope of the invention as set forth in the following claims.

What is claimed is:

1. A golf club head comprising:

a striking face placed at a frontal portion of said golf club head; and a body portion having a crown and a sole, attached to an aft portion of said striking face;

wherein at least a portion of one of said striking face, said crown, or said sole is formed out of a low-damping composite;

said low-damping composite comprising a plurality of fibers, a majority of said plurality of fibers oriented in a first direction, a remainder of said plurality of fibers offset from said first direction, said remainder of said plurality of fibers offset less than 45 degrees from said first direction;

said low-damping composite has a damping loss factor of less than about 0.02;

wherein said golf club head has a first peak in sound power occurring at greater than about 3,500 hertz and less than about 4,500 hertz;

said first peak in sound power is defined as a sound power output of greater than about 0.1 watts.

2. The golf club head of claim 1, wherein said damping loss factor is less than about 0.01.

3. The golf club head of claim 2, wherein said damping loss factor is less than about 0.005.

4. The golf club head of claim 1, wherein at least a portion of said crown is formed from said low damping composite.

5. The golf club head of claim 1, wherein said golf club head has a first peak in sound power occurring at greater than about 3,750 hertz and less than about 4,250 hertz;

said first peak in sound power is defined as a sound power output of greater than about 0.1 watts.

6. The golf club head of claim 5, wherein said golf club head has a first peak in sound power occurring at about 4,000 hertz;

said first peak in sound power is defined as a sound power output of greater than about 0.1 watts.

7. The golf club head of claim 1, wherein said remainder of said plurality of fibers is offset less than 30 degrees from said first direction.

8. The golf club head of claim 1, wherein said remainder of said plurality of fibers is offset less than 15 degrees from said first direction.

9. A golf club head comprising:

a striking face placed at a frontal portion of said golf club head; and a body portion having a crown and a sole, attached to an aft portion of said striking face;

wherein at least a portion of one of said striking face, said crown, or said sole is formed out of a low-damping composite, said low-damping composite comprising a plurality of fibers, a majority of said plurality of fibers oriented in a first direction, a remainder of said plurality of fibers offset from said first direction, said remainder of said plurality of fibers offset less than 45 degrees from said first direction;

wherein said low-damping composite has a performance factor of greater than about 1,100 GPa*cc/g;

said performance factor defined as the Young's Modulus of said low-damping composite divided by the damping loss factor and the density of said low-damping composite;

wherein said golf club head has a first peak in sound power occurring at greater than about 3,500 hertz and less than about 4,500 hertz;

said first peak in sound power is defined as a sound power output of greater than about 0.1 watts.

10. The golf club head of claim 9, wherein said low-damping composite has a performance factor of greater than about 4,000 GPa*cc/g.

11. The golf club head of claim 10, wherein said low-damping composite has a performance factor of greater than about 10,000 GPa*cc/g.

12. The golf club head of claim 9, wherein at least a portion of said crown is formed from said low damping composite.

13. The golf club head of claim 9, wherein said golf club head has a first peak in sound power occurring at greater than about 3,750 hertz and less than about 4,250 hertz;

said first peak in sound power is defined as a sound power output of greater than about 0.1 watts.

14. The golf club head of claim 13, wherein said golf club head has a first peak in sound power occurring at about 4,000 hertz;

said first peak in sound power is defined as a sound power output of greater than about 0.1 watts.

15. The golf club head of claim 9, wherein said low-damping composite forms an internal portion of said striking face of said golf club head.

16. The golf club head of claim 9, wherein said remainder of said plurality of fibers is offset less than 30 degrees from said first direction.

17. The golf club head of claim 9, wherein said remainder of said plurality of fibers is offset less than 15 degrees from said first direction.

18. A golf club head comprising:

a striking face placed at a frontal portion of said golf club head; and a body portion having a crown and a sole, attached to an aft portion of said striking face; and a low damping composite attached to an internal portion of said striking face;

said low-damping composite comprising a plurality of fibers, a majority of said plurality of fibers oriented in a first direction, a remainder of said plurality of fibers offset from said first direction, said remainder of said plurality of fibers offset less than 45 degrees from said first direction;

wherein said golf club head has a first peak in sound power occurring at greater than about 3,500 hertz and less than about 4,500 hertz;

said first peak in sound power is defined as a sound power output of greater than about 0.1 watts.

19. The golf club head of claim 18, wherein said remainder of said plurality of fibers is offset less than 30 degrees from said first direction.

20. The golf club head of claim 18, wherein said remainder of said plurality of fibers is offset less than 15 degrees from said first direction.

* * * * *